US011020801B2

(12) United States Patent
Scholz et al.

(10) Patent No.: US 11,020,801 B2
(45) Date of Patent: Jun. 1, 2021

(54) METHOD AND DEVICE FOR PRODUCING AND CODING METAL POWDER

(71) Applicant: LINDE AKTIENGESELLSCHAFT, Munich (DE)

(72) Inventors: Jürgen Scholz, Munich (DE); Ernst Miklos, Kirchheim (DE); Jim Fieret, Orpington (GB)

(73) Assignee: LINDE AKTIENGESELLSCHAFT, München (DE)

( * ) Notice: Subject to any disclaimer, the term of this patent is extended or adjusted under 35 U.S.C. 154(b) by 147 days.

(21) Appl. No.: 16/300,089

(22) PCT Filed: May 12, 2017

(86) PCT No.: PCT/EP2017/025124

§ 371 (c)(1),
(2) Date: Nov. 9, 2018

(87) PCT Pub. No.: WO2017/194206

PCT Pub. Date: Nov. 16, 2017

(65) Prior Publication Data

US 2019/0160543 A1 May 30, 2019

(30) Foreign Application Priority Data

May 13, 2016 (EP) ..... 16001092

(51) Int. Cl.
*B22F 9/08* (2006.01)

(52) U.S. Cl.
CPC ..... *B22F 9/082* (2013.01); *B22F 2009/084* (2013.01); *B22F 2009/088* (2013.01);
(Continued)

(58) Field of Classification Search
None
See application file for complete search history.

(56) References Cited

U.S. PATENT DOCUMENTS 2,932,741 A 4/1960 McKay
4,891,080 A * 1/1990 Del Corso ..... C22C 38/54 148/326

(Continued)

FOREIGN PATENT DOCUMENTS

DE 10 2010 026 139 A1 1/2012
EP 2 028 283 B1 12/2011

(Continued)

OTHER PUBLICATIONS

PCT International Search Report for PCT/EP2017/025122; dated Aug. 7, 2017; Authorized Officer: Aliouane, Nadir; 8 pgs. total (4 pgs. English language translation).

(Continued)

*Primary Examiner* — George Wyszomierski
(74) *Attorney, Agent, or Firm* — Millen White Zelano & Branigan, PC; Brion P. Heaney

(57) ABSTRACT

The invention relates to a method for coding metal powder. Said method comprises the following steps: providing a melt, forming a melt stream, spraying the melt stream by means of a spraying fluid, and forming metal powder particles from the melt stream. The method is characterized in that, during the spraying of the melt and/or the spraying fluid, a coding component or a coding gas is added in such a way that the use of the coding component in the metal powder can be detected, wherein the gaseous coding component comprises one or more isotopes of at least one gas and the fraction of the at least one isotope is changed in comparison with the naturally occurring fraction of said isotope in the gas and/or wherein the gaseous coding component contains gaseous alloying elements.

14 Claims, 1 Drawing Sheet

Figure 1:
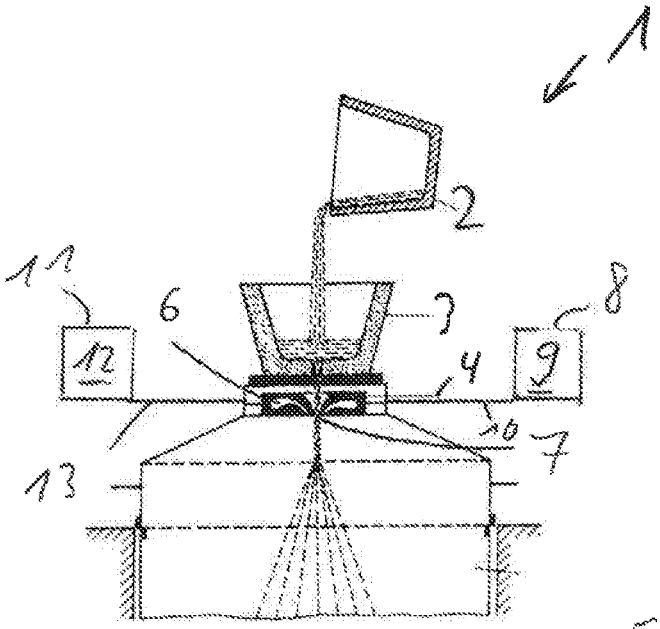

(52) U.S. Cl.
CPC ..... *B22F 2009/0844* (2013.01); *B22F 2009/0848* (2013.01); *B22F 2201/013* (2013.01); *B22F 2201/02* (2013.01); *B22F 2201/03* (2013.01); *B22F 2201/04* (2013.01); *B22F 2201/11* (2013.01); *B22F 2201/12* (2013.01); *B22F 2301/35* (2013.01); *B22F 2303/15* (2013.01); *B22F 2998/10* (2013.01)

(56) References Cited

U.S. PATENT DOCUMENTS

| | | | | |
|---|---|---|---|---|
| 5,586,157 | A | 12/1996 | Gross | |
| 2007/0153965 | A1* | 7/2007 | Choi | C23C 4/12 376/417 |
| 2010/0310404 | A1 | 12/2010 | Ackelid | |
| 2012/0035061 | A1 | 2/2012 | Bransky et al. | |
| 2012/0223059 | A1 | 9/2012 | Ackelid | |
| 2014/0370323 | A1 | 12/2014 | Ackelid | |
| 2014/0373679 | A1 | 12/2014 | Heidloff | |
| 2015/0279524 | A1 | 10/2015 | Reep et al. | |
| 2016/0145747 | A1 | 5/2016 | Watson et al. | |
| 2016/0145758 | A1 | 5/2016 | King et al. | |
| 2016/0153102 | A1 | 6/2016 | Watson et al. | |
| 2016/0161242 | A1 | 6/2016 | Cook et al. | |
| 2016/0168716 | A1 | 6/2016 | Kling et al. | |
| 2016/0169783 | A1 | 6/2016 | Levasseur et al. | |
| 2016/0253586 | A1 | 9/2016 | Cook et al. | |
| 2018/0145755 | A1 | 5/2018 | Bartley et al. | |
| 2019/0176266 | A1* | 6/2019 | Scholz | B22F 3/105 |

FOREIGN PATENT DOCUMENTS

| | | | |
|---|---|---|---|
| JP | 2002 097532 | A | 4/2002 |
| JP | 2013 040074 | A | 2/2013 |
| WO | WO 2015/185155 | A1 | 12/2015 |

OTHER PUBLICATIONS

PCT Written Opinion for PCT/EP2017/025122; dated Aug. 7, 2017; Authorized Officer: Aliouane, Nadir; 7 pgs. total.
PCT International Search Report for PCT/EP2017/025124; dated Sep. 1, 2017; Authorized Officer: Morra, Valentina; 6 pgs. total (2 pgs. English language translation).
PCT Written Opinion for PCT/EP2017/025124; dated Sep. 1, 2017; Authorized Officer: Morra, Valentina; 6 pgs. total.

* cited by examiner

METHOD AND DEVICE FOR PRODUCING AND CODING METAL POWDER

The present invention relates to a method and a device for producing and coding metal powder.

There are numerous methods for producing metal powder. These include the mechanical comminution of solid metal, the separation of saline solutions, the thermal decomposition of a chemical compound, the reduction of a chemical compound, mostly of the oxide in solid phase, the electrolytic depositing and the spraying of liquid metal. The three last-mentioned methods are used most frequently in practice to produce metal powder.

In response to the spraying, molten metal is split into droplets and is solidified quickly, before the melt droplets come into contact with each other or with a solid surface. The principle of this method is based on the comminution of a thin, liquid metal stream by means of a gas or liquid stream, which hits at a high speed. Air, nitrogen and argon are the most frequently used gases, in particular water is used as liquid.

Other methods for the melt splitting are also used more and more, such as, e.g., the centrifugal spraying, in response to which melt droplets are centrifuged away from a rotating source.

While the water spraying is used in particular for the production of powders of iron, steel, copper and copper alloys, aluminum and zinc are sprayed predominantly, copper partially under air.

First of all, a melt of the metal to be sprayed or of the alloy to be sprayed is formed for the compressed air spraying and is overheated accordingly. For the most part, this overheated melt runs across a second smaller crucible or a pouring funnel and forms a melt stream there, which falls perpendicularly through a nozzle construction. The melt stream is atomized by means of a gas (carrier gas) and the droplets, which are created, solidify in a movement in a spraying chamber. The metal powder is separated from the carrier gas in the spraying chamber and/or in the downstream gas purification unit (cyclone, filter).

Low carbon steel melts, which are produced in the LD method, are preferably used in the industrial steel powder recovery by means of water spraying. A further option for the steel powder recovery is the use of sorted scrap and to melt the latter in an arc furnace.

High-purity powders of special steel, super alloys and other highly-alloyed or oxidation-sensitive materials, respectively, can be produced in an advantages manner by spraying with inert gas. For the most part, this method provides spherical powders, which are hardly suitable for the conventional mechanical pressing of molded parts, but are particularly suitable for a processing by isostatic pressing and powder injection molding.

On an industrial scale, the ASEA-STORA method is often used to spray high-speed steel melts. By using purified inert gas, such as, e.g. $N_2$ and Ar, and by working in a closed system, powders comprising approximately 100 ppm of oxygen can be created. To increase the cool-down speed of the metal droplets, the spraying chamber is cooled from the outside and a water-cooled bottom is used for collecting the powders.

Another method comprises the spraying with gases in a Laval nozzle according to NANOVAL. Methods, which do not allow the contact of the molten metal with ceramic crucible material, are advantageous for the creation of pure spherical metal powders of reactive metals, such as titanium or zirconium, because this could lead to an oxidation of the melt and possibly to the destruction of the crucible. The reactive metal is thus melted inductively or by means of plasma in a cooled copper crucible. A thin solidified layer of the metal to be sprayed, which effectively prevents a reaction of the melt with the crucible material, forms between copper crucible and melt.

The EIGA method represents another option for the ceramic-free metal spraying, which is particularly suitable for reactive materials and which is used, e.g., in the production of titanium powder. In the case of this method, the metal to be sprayed or the alloy to be sprayed, respectively, is supplied perpendicularly as electrode in rod shape to an annular induction coil and is melted here on the surface. To ensure a uniform melting, the rod is subjected to a rotational movement during the method. The melt created in this way finally drips through an annular nozzle in free fall, is atomized here, and solidifies. The powder is subsequently deposited into a spraying container.

The plasma spraying is also used for the production of pure spherical titanium and titanium alloy powder. A wire with a diameter of approx. 3 mm made of the alloy to be sprayed is supplied to an arrangement of three plasma torches, where it is melted and atomized in one step. An end product of the highest purity is obtained as a result of the purity of the starting material, the lack of any crucible material, and the melting under inert atmosphere.

A splitting of melts under vacuum, which, as a matter of principle, need to also be classified as spraying, is possible with the help of inert gases or hydrogen. The melt, which is enriched with the gas under pressure, is pushed into an evacuated chamber in a thin stream. The expansion of the gas, which dissolved in the melt, splits it into fine droplets.

Metal powders are frequently subjected to an annealing treatment after the production. A reduction of the powders is necessary, e.g., when the powder particles have oxidized more or less on the surface as a result of longer or unfavorable storage (increased moisture and temperature). The reduction is carried out in conventional furnaces, which are also used for the sintering. Pure hydrogen and dissociated ammonia are used most frequently as reduction atmosphere.

A wide-ranging problem in the production of starting materials is that it is currently not possible to differentiate the starting materials, such as, e.g., metal powder and thus also components produced therefrom, from forgeries or cheap copies, respectively, in a simple and safe manner. In most cases, it is difficult to determine, whether a starting material or a component is made by the original manufacturer (Original Equipment Manufacture (OEM)) or whether a starting material or a component is a copy made by a third party, because they can hardly be differentiated from one another on the basis of their appearance. However, significant qualitative differences (strength, elasticity, hardness, porosity, ductility, etc.) can exist.

It is in particular problematic that for example the generative manufacturing makes it possible to easily copy or to forge, respectively, components without extensive development or production costs or production methods, respectively, in a small quantity. In the industry, there is the need for unambiguous markings of the starting materials, so as to be able to clarify the question of liability, in particular in the event of damage.

Existing options for coding a component by means of embossing or engraving are limited with regard to the geometry or the functionality of the component. For example, the surface engraving by means of laser is only economically expedient, if it is integrated into the production process. In addition, it requires a special positioning of the laser beam with regard to its angle relative to the component. So-called DNA-paintings can be removed easily. It is also known to identify components by means of radio frequency methods. This technology, however, is very expensive and it is in particular difficult and costly to attach it to individual components. Manufacturers thus mostly mark a complete device or a machine, respectively, at a single spot and not each individual component of this machine. Such a marking of a complete machine thus does not protect against forgeries, if for example replacement parts are installed into this machine.

It is thus the object of the present invention to provide a simple, safe and reliable method for coding starting materials, in particular metal powders, if possible without additional operating steps.

This object is solved by means of the independent claims. Advantageous embodiments are specified in the subclaims.

According to the invention, a method for coding metal powder is provided. This method comprises the following steps:

providing a melt, forming a melt stream, spraying the melt stream by means of a spraying fluid, and forming metal powder particles from the melt stream.

The method is characterized in that, during the spraying of the melt and/or the spraying fluid, a coding component or a coding gas is added in such a way that the use of the coding component in the metal powder can be detected, wherein the gaseous coding component comprises one or more isotopes of at least one gas and the fraction of the at least one isotope is changed in comparison with the naturally occurring fraction of said isotope in the gas and/or wherein the gaseous coding component contains gaseous alloying elements.

It is possible to safely and reliably code a metal powder in a simple and cost-efficient manner by means of the method according to the invention.

It is in particular advantageous that no additional production step is necessary for coding the metal powder. The coding takes place in that, during the spraying, a coding component is applied to the melt. If this gaseous coding component is chemically active, it reacts with the metal and the reaction product (e.g. an oxide, nitride, carbide) is embedded into the metallic structure. However, coding molecules, which do not react (because the local temperature is too low, e.g.), can be caught in the small spaces of the granular structure. This mechanism also works in the case of inert gases. They can remain caught in the component in their original state.

The coding component in the metal powder and/or in the finished component, for example can be detected by means of chemical analysis methods or by means of a mass spectrometer. This can take place in a laboratory or with mobile devices.

A further advantage is that the production parameters do not need to be changed or adapted as a result of the coding during the production of the metal powder.

It is also advantageous that the coding does not require an additional production step.

Coding information can furthermore be recorded.

Recording can be understood as the powder-specific storing of the data in electronic form or the printing of the information on a certificate, e.g. also in machine-readable form.

The recording of coding information can comprise, for example, the storing of coding information in a database, on a chip, etc.

Due to the fact that the coding information is recorded and/or stored in a database, it is noted accurately or recorded, respectively, which coding component had been introduced into the metal powder.

The coding information can thus include information about the type and the composition of the coding component.

Based on the coding information, it can be determined at a later point in time in a simple manner, namely in that the metal powder is analyzed, whether or not it is an original component.

Such a coding is virtually forgery-proof, because a potential forger does not have the coding information and the latter is not visible from the outside.

Based on the coding information, the metal powder can thus be detected with regard to its coding component for example by means of a chemical analysis method by means of a mass spectrometer.

In the context of the present invention, the production of metal powder is understood to be a method, such as, e.g., the spraying.

In response to the spraying, molten metal is split into droplets and is solidified quickly, before the melt droplets come into contact with each other or with a solid surface. The principle of this method is based on the splitting of a thin, liquid metal stream by means of a flow of a spraying fluid, such as, e.g., a gas or liquid flow, which hits at high speed.

Air, nitrogen and argon can be provided as gaseous spraying fluid. In particular water can be provided as liquid spraying fluid. A gaseous spraying fluid is preferably used.

In this respect, reference is made to the methods mentioned in the introductory description for spraying with gas, water or centrifugal force.

The gaseous spraying fluid can comprise an inert gas, such as, e.g., argon, helium, neon, krypton, xenon or radon, or an active gas, such as, e.g., $O_2$, $CO_2$, $H_2$ and $N_2$, or also mixtures thereof.

A mixture of gaseous spraying fluid and coding component will be referred to as spraying gas below.

Preferably, oxygen 18 carbon dioxide ($C^{18}O_2$), carbon 13 carbon dioxide ($^{13}CO_2$), carbon 13 carbon monoxide ($^{13}CO$), deuterium ($D_2$), nitrogen 15 ($^{15}N_2$) and oxygen 18 ($^{18}O_2$) is provided as coding component, which can be mixed with a corresponding gaseous spraying fluid or which can also be used in pure form.

The coding component thus comprises for example one or more isotopes of a gas, preferably of the spraying medium, wherein the fraction of an isotope in comparison with the natural fraction of the isotopes in the gas is changed. This means that the ratio of the isotopes is changed in comparison with the naturally occurring ratio. For example in the case of nitrogen, the ratio of $^{15}N$ (frequency=99.634) to $^{15}N$ (frequency=0.366) is changed in such a way that the fraction of $^{15}N$ is increased and the fraction of N14 is reduced or vice versa. For example in the case of carbon, the ratio of $^{12}C$ (frequency=98.9) to $^{13}C$ (frequency=1.1) is changed in such a way that the fraction of $^{13}C$ is increased and the fraction of $^{12}C$ is reduced or vice versa. In the case of hydrogen for example, the ratio of H (frequency=98.9885) to $^{2}H$ (frequency=0.0115) can be changed in such a way that the fraction of $^{2}H$ is increased and the fraction of H is reduced or vice versa.

It can be provided for example that the frequency of the isotopes in comparison with the naturally occurring frequency is increased or reduced approximately by or more than 0.5% or 1.0% or 1.5% or 2.5% or 5.0% or 10.0% or 25% or 50.0% or 75% or 100% or 150% or 200% or 500% or 1000%.

Nitrogen 15 and nitrogen 14 and/or carbon 12, carbon 13 and/or carbon 14 and/or also for example oxygen 16 and/or oxygen 18 are preferably provided as isotopes. Argon-36, -38, -39, -40 can furthermore be provided as well. Argon is indeed inert and does not react with the material, but because a 100% component density is not reached in particular in the case of the powder bed methods, it is possible to provide gaseous inclusions for the coding. However, the use of hydrogen 2 or hydrogen 3 as well as helium 3 and helium 4 isotopes is conceivable as well on principle.

To provide more complex codings, two or more different isotopes can also be contained in the coding component. The coding component can accordingly comprise one or more isotopes of the process gas other than the naturally occurring isotopes. For example, oxygen isotopes can be combined with nitrogen isotopes or C-isotopes in the $CO_2$ can also be combined with H-isotopes in $H_2$.

In addition or in the alternative to the isotopes, the coding component can also comprise gaseous alloying elements, wherein the fraction of the gaseous alloying element is preferably selected in such a way that the gaseous alloying element changes the material properties of the metal powder only insignificantly.

The inclusion of the gaseous alloying elements in the metal powder is so large that the alloying elements in the metal power and preferably even in the finished component can be detected, e.g. by means of metallurgical and/or chemical and/or magnetic resonance analysis methods.

According to the invention, a device for producing and coding metal powder is also provided. It comprises:

an apparatus for providing a melt, a nozzle apparatus for spraying the melt by means of a spraying fluid, a spraying chamber for forming metal powder particles from the sprayed melt by means of a spraying fluid.

The device is characterized in that a coding component supplying apparatus is provided, which adds a coding component or a coding gas to the sprayed melt and/or to the spraying fluid in such a way that the use of the coding component in the metal powder can be detected, wherein the gaseous coding component preferably comprises one or more isotopes of at least one gas, and the fraction of the at least one isotope in comparison with the naturally occurring fraction of said isotope in the gas is changed and/or wherein the gaseous coding component contains gaseous alloying elements.

In addition, a database for storing coding information can be provided.

The advantages of the device according to the invention correspond essentially to the advantages of the method according to the invention.

The coding component supplying apparatus can furthermore comprise a mixing chamber for admixing the coding component to the spraying fluid, wherein a coding component or a process gas or a mixture of process gas and coding component can be supplied to the component from the mixing chamber, at least area by area. The mixing chamber accordingly has a first inlet for supplying a process gas, and a second inlet for supplying a coding component, or a second inlet for supplying a process gas containing a coding component, and an outlet, which is connected to a nozzle. Such an external mixing chamber is advantageous, because existing systems or devices, respectively, can be upgraded therewith in such a way that a coding of a component is possible.

The coding component supply apparatus can also comprise at least one nozzle, in order to introduce the coding component or a gas containing the coding component into the spraying chamber.

The nozzle apparatus itself can also have two inlets, wherein one inlet is provided for supplying gaseous spraying fluid, and the other inlet for supplying a coding component or a gas (premix) containing a coding component from corresponding storage containers.

The gaseous spraying fluid is formed or made up, respectively, in such a way that it can ensure the chemically metallurgically desired properties of the metal powder and additionally provides for an unambiguous marking or coding, respectively. Gaseous spraying fluids comprising corresponding coding components thus need to be provided. The coding component can thus also be provided as premix from a gas storage container, which comprises process gas as well as a corresponding fraction of coding component. This gas storage container containing the premix then forms the coding component supply apparatus.

The coding component supply apparatus can thus be the mixing chamber, the premix storage container or the storage container containing the coding component, if applicable with corresponding nozzles.

The addition of the coding component can be controlled by a controller. This controller can comprise a coding component regulator comprising a closed loop, which regulates the addition. By means of a sensor, the coding component regulator captures an actual value of one or more volume flows in the spraying chamber and/or a spraying nozzle and/or the spraying chamber and/or the mixing chamber and/or a spraying fluid chamber, compares said actual value to a predetermined setpoint value of one or more volume flows, and the predetermined setpoint value is then set via a regulating unit.

Volume flow or flows, respectively, are understood to be the values of the corresponding gas flows, which the coding component supply apparatus supplies to the spraying chamber and/or the spraying apparatus.

It is furthermore in accordance with the invention to provide a coding gas for coding metal powder. Said coding gas comprises a spraying gas and is characterized in that the spraying gas contains a coding component, wherein the gaseous coding component comprises one or more isotopes of at least one gas, and the fraction of the at least one isotope in comparison with the naturally occurring fraction of said isotope in the gas is changed, and/or wherein the gaseous coding component contains gaseous alloying elements.

By using such a coding gas, a subsequent unambiguous marking or identification, respectively, of a metal powder and even of a component is possible. The coding component of the coding gas is introduced into the metal powder during the production or into the component by processing the metal powder, and thus becomes part of the metal powder and of the component produced therefrom.

The spraying gas can comprise an inert gas, such as, e.g., argon, helium, neon, krypton, xenon or radon, and/or an active gas, such as, e.g., $O_2$, $CO_2$, $H_2$ and $N_2$, or also mixtures thereof.

The coding component can preferably comprise oxygen 18 carbon dioxide ($C^{18}O_2$), carbon 13 carbon dioxide ($^{13}CO_2$), carbon 13 carbon monoxide ($^{13}CO_2$), deuterium ($D_2$), nitrogen 15 ($^{15}N_2$) and oxygen 18 ($^{18}O_2$) or also mixtures thereof.

The frequency of the isotope in comparison with the naturally occurring frequency can be increased or reduced by 0.5% or by 1.0% or by 1.5% or by 2.5% or by 5.0% or by 10.0% or by 25% or by 50.0% or by 75% or by 100% or by 150% or by 200% or by 500% or by 1000%.

Examples for concrete specifications for increasing or reducing the isotope ratios are specified in the table below.

| Type of coding | Element | Type of the isotope used to enrich a base gas to provide a coding | Naturally occurring concentration of the isotopes | Possible molecules | Range of the isotopic metering to a base gas |
|---|---|---|---|---|---|
| Inert isotopes, for inclusion in micro-porosities of a component | Ar | $^{38}Ar$ | $^{36}Ar$: 0.337%<br>$^{38}Ar$: 0.063%<br>$^{40}Ar$: 99.6% | N/A | Between 1.1-times and 10-times the naturally occurring fraction of the isotope or less than or equal to 0.9-times the natural fraction |
| | He | $^{3}He$ | $^{3}He$: 0.000137%<br>Remainder: $^{4}He$ | N/A | Between 1.1-times and 10-times the naturally occurring fraction of the isotope or less than or equal to 0.9-times the natural fraction |
| | H | $^{2}H$ | $^{2}H$: 0.012%<br>Remainder $^{1}H$ | $^{2}H_2$<br>$^{2}H^{1}H$<br>$N^{2}H_3$ | $^{2}H_2$: between 1 ppm and 10 ppm<br>$^{2}H^{1}H$: between 1.1-times and 10-times the naturally occurring fraction of the isotope or less than or equal to 0.9-times the natural fraction<br>$N^{2}H_3$: between 1 ppm and 10 ppm |
| | Kr | $^{78}Kr$<br>$^{82}Kr$<br>$^{84}Kr$<br>$^{86}Kr$ | $^{78}Kr$: 0.35%<br>$^{80}Kr$: 2.25%<br>$^{82}Kr$: 11.6%<br>$^{83}Kr$: 11.5%<br>$^{84}Kr$: 17.3%<br>$^{88}Kr$: 17.3% | N/A | $^{78}Kr$ and $^{82}Kr$: between 1.1-times and 10-times the naturally occurring fraction of the isotope or less than or equal to 0.9-times the natural fraction<br>Others: between 1.001-times and 1.1-times the naturally occurring fraction of the isotope or less than or equal to 0.99-times the natural fraction |
| | Ne | $^{20}Ne^{21}Ne^{22}Ne$ | $^{20}Ne$: 90.48%<br>$^{21}Ne$: 0.27%<br>$^{22}Ne$: 9.25% | N/A | $^{21}Ne$ and $^{22}Ne$: between 1.001-times and 1.1-times the naturally occurring fraction of the isotope or less than or equal to 0.99-times the natural fraction |
| | Xe | $^{124}Xe$<br>$^{129}Xe$<br>$^{131}Xe$<br>$^{132}Xe$<br>$^{134}Xe$<br>$^{136}Xe$ | $^{124}Xe$: 0.095%<br>$^{126}Xe$: 0.089%<br>$^{128}Xe$: 1.91%<br>$^{129}Xe$: 26.4%<br>$^{130}Xe$: 4.07%<br>$^{131}Xe$: 21.2%<br>$^{132}Xe$: 26.9%<br>$^{134}Xe$: 10.4%<br>$^{136}Xe$: 8.86% | N/a | $^{124}Xe$, $^{129}Xe$: between 1.1-times and 10-times the naturally occurring fraction of the isotope or less than or equal to 0.9-times the natural fraction<br>Others: between 1.001-times and 1.1-times the naturally occurring fraction of the isotope or less than or equal to 0.99-times the natural fraction |
| Reactive isotopes, which form connections, which are suitable for coding, with the material of the component | C | $^{12}C$<br>$^{13}C$ | $^{12}C$: 98.8%<br>$^{13}C$: 1.1% | $^{12}CO$<br>$^{13}CO$<br>$^{13}CO_2$ | $^{13}CO$, $^{13}CO_2$: between 1.1-times and 10-times the naturally occurring fraction of the isotope or less than or equal to 0.9-times the natural fraction |
| | O | $^{17}O$<br>$^{18}O$ | $^{16}O$: 99.76%<br>$^{17}O$: 0.039%<br>$^{18}O$: 0.201% | $^{18}O_2$<br>$^{17}O_2$<br>$C^{18}O_2$ | $^{17}O_2$, $^{18}O_2$, $C^{18}O_2$: between 1.1-times and 10-times the naturally occurring fraction of the isotope or less than or equal to 0.9-times the natural fraction of the two oxygen isotopes |
| | N | $^{15}N$ | $^{14}N$: 99.634%<br>$^{15}N$: 0.366% | $^{15}N_2$<br>$^{15}NH_3$ | $^{15}N_2$, $^{15}NH_3$: between 1.01-times and 1.1-times the naturally occurring fraction of the isotope or less than or equal to 0.99-times the natural fraction of the $^{15}N$ isotope |

The coding component can contain at least one isotope of an active gas, which reacts with the material of the metal powder to be produced in such a way that it remains in the metal powder.

The coding component can comprise at least one isotope of an inert gas, wherein the isotope becomes included in the metal powder.

The coding component can contain several different isotopes (isotopes of different gases) in predetermined ratios, wherein the different isotopes form the coding in the component.

The isotopes can be isotopes of the gas, which forms the main component of the spraying gas.

The isotopes can also be isotopes, which do not occur in the process gas.

Nitrogen $^{15}N$ isotopes can sometimes behave in an inert manner and sometimes in a reactive manner, depending on the alloying element, the temperature, the concentration and/or the reaction time.

Hydrogen isotopes can also be included in micro-porosities in the gaseous state, can react with atomic oxygen $O_2$ and can dissolve, or they can form metallic hydrides by means of adsorption on metallic surfaces and can remain in the component.

Carbon isotopes $^{12}C$ and $^{13}C$ are provided in the form of carbon dioxide, which is then separated in the method.

Some isotopes of H, N, CO can be to the method as part of a chemical compound, such as, e.g.: $C^{18}$, $O_2$, $^{13}CO_2$, $N^2H_3$, and $^{15}NH_3$.

The admixed isotopes can be formed from gases, which are metallurgically harmless and which do not impact the material properties.

The coding component can comprise a gaseous alloying element, wherein the fraction of the gaseous alloying element is selected in such a way that the gaseous alloying element changes the material properties of the component only insignificantly.

The coding gas can be provided for coding metal powder in response to the production thereof according to the above-described method. The coded metal powder is subsequently used for example in response to the generative manufacturing of components (also referred to as "additive manufacturing" or "3D print").

The invention will be described in more detail below by means of the figures.

Figure 2:
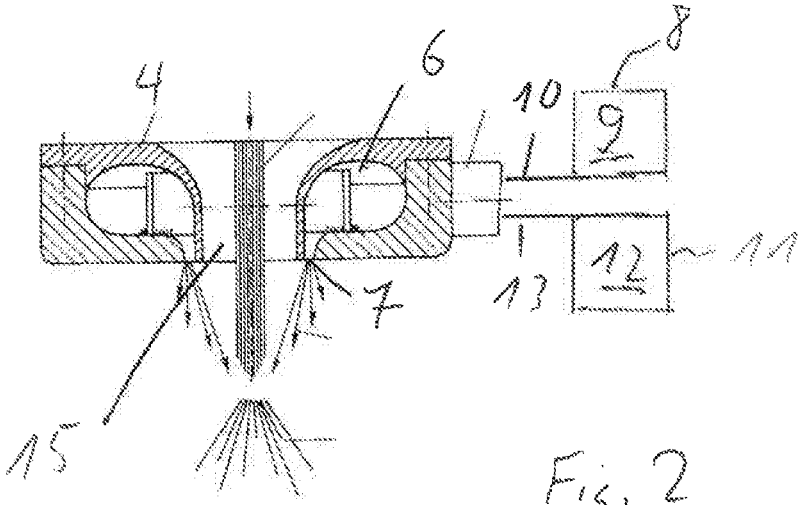

FIG. 1 shows a schematic, laterally cut illustration of a device according to the invention for producing and coding metal powder, and FIG. 2 shows a schematic, laterally cut illustration of a nozzle apparatus of the device from FIG. 1.

A device according to the invention for coding metal powder by means of a device 1 for producing metal powder by spraying will be described below (FIG. 1).

This device 1 comprises a crucible 2 for providing a metal melt.

The device 1 furthermore comprises a pouring funnel 3, which can be filled with melt by means of the crucible 2. The pouring funnel 3 is provided with a ceramic coating.

An outlet channel 4 of the pouring funnel 3 leads into a nozzle apparatus 4.

The nozzle apparatus 4 centrally comprises a passage opening 5, via which a melt stream, which is formed by the outlet channel 4 of the pouring funnel 3, can pass through.

The passage opening 5 is surrounded by an annular spraying fluid chamber 6 for receiving and distributing a spraying fluid. The spraying fluid chamber 6 leads into an annular gap 7, which is arranged concentrically to the passage opening 5. The annular gap 7 forms a spraying nozzle for creating melt droplets from the melt stream.

In addition, a spraying fluid supply apparatus 8 is provided, by means of which a spraying fluid can be applied to the spraying fluid chamber 6.

The spraying fluid supply apparatus 8 has a spraying fluid storage container 9 for the spraying fluid, wherein the spraying fluid storage container 9 is connected to the spraying fluid chamber 6 via a line section 10.

A coding component supply apparatus 11 is also provided. The coding component supply apparatus 11 comprises a coding component storage container 12. The coding component storage container 12 is connected to the spraying fluid chamber 6 via a line section 13.

A coding gas or a gaseous coding component is stored in the coding component storage container 12.

In the alternative, a mixing chamber (not illustrated) can be provided. The mixing chamber has an inlet for supplying spraying fluid from the spraying fluid storage container 9, and an inlet for supplying coding component from the coding component storage container 12 for the coding component.

The spraying fluid and the coding component or a coding gas can also be provided as premix from a gas storage container (not illustrated), which contains spraying fluid as well as a corresponding fraction of coding component. This gas storage container, which contains the premix, then forms the coding component supply apparatus and is directly connected to the spraying fluid chamber 6, in addition to the storage container for the spraying fluid, or to the mixing chamber.

The passage opening 5 as well as the spraying nozzle 7 of the nozzle apparatus lead into a spraying chamber 8 for spraying the melt droplets in powder particles.

A controller (not illustrated) for controlling the addition of the coding component is also provided. The controller comprise a coding component regulator comprising a closed loop, which regulates the addition. The coding component regulator can comprise a P-regulator, an I-regulator, a D-regulator, and combinations thereof, such as, e.g. a PID-regulator. The coding component regulator captures an actual value of the one or more volume flows in the spraying fluid chamber and/or spraying chamber and/or the mixing chamber by means of a sensor, compares said actual value to a predetermined setpoint value of one or more volume flows, and the predetermined setpoint value is then set via a regulating unit.

A method according to the invention for coding metal powder will be described below.

First of all, a melt of a metal to be sprayed or of an alloy to be sprayed is formed and overheated in the crucible 2.

The overheated melt is subsequently introduced into the pouring funnel 3 and, in the outlet channel 4 thereof, forms a melt stream, which passes perpendicularly through the passage opening 5 of the nozzle apparatus 4.

This melt stream is atomized and coded via the spraying nozzle 7 of the nozzle apparatus 4 in the spraying chamber 14 by means of the spraying medium and the coding component. The resulting droplets solidify in the movement in the spraying chamber 14.

It can furthermore be provided, either in the spraying chamber 14 and/or in downstream gas purification systems (cyclones, filters) to separate the metal powder from the spraying fluid.

In a next step, the metal powder can be analyzed with the help of a detection apparatus, such as for example a mass spectrometer (gas chromatograph) and the coding or the originality, respectively, of the metal powder can thus be verified. An analysis by means of magnetic resonance or also chemical analysis methods are possible.

Due to the coding component, the metal powder obtains a unique isotopic signature.

The coding information is stored in a database.

It is thus possible by means of the method according to the invention to code a metal powder and to subsequently detect this coding.

The coding gas comprises for example the spraying medium and the coding component in such a way that the fraction of nitrogen 15 and nitrogen 14 isotopes in comparison with the natural fraction of nitrogen 15 and nitrogen 14 isotopes or the radio thereof, respectively, is changed. For example in the case of nitrogen, the ratio of $^{15}N$ (frequency=99.634) to $^{15}N$ (frequency=0.366) is changed in such a way that the fraction of $^{15}N$ is increased and the fraction of $^{14}N$ is reduced (or vice versa).

According to the invention, the used isotopes can be isotopes of the spraying fluid, which means that for example when using nitrogen as spraying fluid, the ratio of nitrogen 15 to nitrogen 14 isotopes is changed. For example, carbon dioxide, which contains carbon 12, carbon 13, and carbon 14 isotopes, can also be provided.

On principle, inert isotopes can be used independently from the material, because the embedding into the microporosities is a purely mechanical process.

It is also possible, however, to add other isotopes of another gas, together with a fraction of said other gas, as coding component to the spraying fluid.

According to a further exemplary embodiment of the method according to the invention, a gaseous alloying element is provided in addition or as an alternative as coding component. It can for example be provided hereby to use an inert gas, such as argon, as process gas, which contains a small fraction of between 1 ppm and 10.000 ppm of nitrogen 15 as coding component. Titanium is contained in the metallic starting material. In response to the production of the three-dimensional component, a smaller fraction of the titanium accordingly reacts with the nitrogen 15 and forms titanium nitride 15. In its chemical and physical properties, said titanium nitride 15 cannot be differentiated from titanium nitride 14, and it can thus not be detected by means of chemical analysis methods. It is possible, however, to analyze the component by means of a mass spectrometer. It is then determined thereby that the component had been produced under a nitrogen atmosphere with increased nitrogen 15 fraction.

LIST OF REFERENCE NUMERALS

1 device
2 crucible
3 pouring funnel
4 nozzle apparatus
5 passage opening
6 spraying fluid chamber
7 spraying nozzle
8 spraying fluid supply apparatus
9 spraying fluid storage container
10 line section
11 coding component supply apparatus
12 coding component storage container
13 line section
14 spraying chamber
15 outlet channel

The invention claimed is:

1. A method for producing and coding metal powder, comprising:

providing a melt;

forming a melt stream;

spraying the melt stream by means of a spraying fluid; and forming metal powder particles from the melt stream;

wherein, during the spraying of the melt and/or the spraying fluid, a coding component is added in such a way that the use of the coding component in the metal powder can be detected, and wherein the coding component comprises one or more isotopes of at least one gas and the fraction of the at least one isotope is changed in comparison with the naturally occurring fraction of said isotope in the gas.

2. The method of claim 1, wherein information about the coding component and the composition thereof is stored in a database.

3. The method of claim 2, wherein the metal powder is detected by means of a chemical analysis method or by means of a mass spectrometer.

4. The method of claim 2, wherein the metal powder is detected by means of a chemical analysis method or by means of a mass spectrometer and the coding component of the metal powder is verified by comparison with the stored information about the coding component.

5. The method of claim 1, wherein the spraying fluid comprises an inert gas selected from:

argon, helium, neon, krypton, xenon and radon; or an active gas selected from the group consisting of $O_2$, $CO_2$, $H_2$, $N_2$, and mixtures thereof; and the coding component comprises a component selected from oxygen 18 carbon dioxide ($C^{18}O_2$), carbon 13 carbon dioxide ($^{13}CO_2$), carbon 13 carbon monoxide ($^{13}CO$), deuterium ($D_2$), nitrogen 15 ($^{15}N_2$) and oxygen 18 ($^{18}O_2$), and mixtures thereof.

6. The method of claim 1, wherein the frequency of the isotopes in comparison with the naturally occurring frequency is increased or reduced by more than 0.5%.

7. The method of claim 1, wherein the coding component contains at least one isotope of an active gas, which reacts with the powder particles of the metal powder in such a way that the at least one isotope of the active gas it remains in the powder particles of the metal powder.

8. The method of claim 1, wherein the coding component comprises one or more isotopes of the spraying fluid, wherein the fraction of one or more isotopes of the spraying fluid in the coding component is changed in comparison with the natural fraction of the one or more isotopes in the spraying fluid, wherein the different isotopes form the coding in the coding component.

9. The method of claim 1, wherein the isotopes are isotopes of the gas, which forms the main component of the spraying fluid.

10. The method of claim 1, wherein the coding component comprises a gaseous alloying element.

11. The method of claim 1, wherein the frequency of the isotopes in comparison with the naturally occurring frequency is increased or reduced by more than 0 1.0%.

12. The method of claim 1, wherein the frequency of the isotopes in comparison with the naturally occurring frequency is increased or reduced by more than 5%.

13. The method of claim 1, wherein the coding component comprises at least one isotope of an inert gas, wherein the isotope becomes included in the metal powder.

14. The method of claim 1, wherein the isotopes are different from the isotopes of the spraying fluid.

* * * * *